US007172486B2

(12) United States Patent
Drosendahl et al.

(10) Patent No.: US 7,172,486 B2
(45) Date of Patent: Feb. 6, 2007

(54) CONVERTIBLE ENTERTAINMENT DEVICE

(75) Inventors: Christine Ann Drosendahl, East Aurora, NY (US); Seth Frankel, Culver City, CA (US); Robert W. Jourdian, East Aurora, NY (US); Albert Maggiore, Lancaster, NY (US)

(73) Assignee: Mattel, Inc., El Segundo, CA (US)

( * ) Notice: Subject to any disclaimer, the term of this patent is extended or adjusted under 35 U.S.C. 154(b) by 718 days.

(21) Appl. No.: 09/968,495

(22) Filed: Oct. 2, 2001

(65) Prior Publication Data

US 2003/0064818 A1 Apr. 3, 2003

(51) Int. Cl.
*A63H 5/00* (2006.01)

(52) U.S. Cl. ..... 446/81; 446/175; 446/227; 446/484; 446/485

(58) Field of Classification Search ..... 446/81, 446/227, 175, 397, 484, 485, 486, 487, 394; 40/430–432, 473; 362/388, 371, 413, 396, 362/430, 184, 186, 188, 231, 370, 368, 418, 362/419, 427, 806, 402; 248/104; 472/119
See application file for complete search history.

(56) References Cited

U.S. PATENT DOCUMENTS 1,084,375 A * 1/1914 Swinehart ..... 362/269
1,708,047 A * 4/1929 Bosworth ..... 362/427
1,786,459 A * 12/1930 Simons ..... 248/104
1,811,618 A * 6/1931 Parris ..... 271/183
1,811,818 A * 6/1931 Parris ..... 40/477
2,299,683 A * 10/1942 Curtis ..... 248/122.1
2,301,661 A * 11/1942 Wiedenhoeft ..... 248/284.1
2,823,477 A * 2/1958 Willard ..... 40/554
3,109,252 A * 11/1963 Hanspaul ..... 40/554
D213,982 S 4/1969 Simon
3,628,005 A 12/1971 Rhoades
3,919,795 A 11/1975 Van Horne Jinivisan et al.
3,927,482 A * 12/1975 Marcus ..... 40/455
4,147,344 A * 4/1979 Lee ..... 482/129
4,214,808 A 7/1980 Hampson
4,285,028 A * 8/1981 Sundin et al. ..... 362/35
4,363,181 A * 12/1982 Hyman et al. ..... 40/466
4,573,654 A 3/1986 Nottingham
4,640,034 A 2/1987 Zisholtz
4,756,109 A 7/1988 Marcus
4,858,079 A 8/1989 Ohashi (Continued)

FOREIGN PATENT DOCUMENTS

CH 172 498 A 10/1934

(Continued)

*Primary Examiner*—Bena Miller
(74) *Attorney, Agent, or Firm*—Cooley Godward Kronish LLP

(57) ABSTRACT

An apparatus having a support arm, a base coupled to the support arm to maintain the support arm in upright orientation and moveable between a first orientation in which the base is coupleable to a vertical surface, and a second orientation in which the base can rest on a horizontal surface. A light source is coupled to the support arm and a mobile coupled to said support arm, whereby when the base is in the first orientation, the apparatus can be coupled to a crib rail to function as a crib mobile, and when the base is in the second orientation, the apparatus can rest on a horizontal surface to function as a lamp.

40 Claims, 14 Drawing Sheets

U.S. PATENT DOCUMENTS 4,911,489 A * 3/1990 Hansen et al. ..... 292/336.3
4,939,582 A 7/1990 Holdredge et al.
4,984,380 A * 1/1991 Anderson ..... 40/455
5,029,047 A 7/1991 Kachel
5,192,041 A 3/1993 Bryant
5,324,224 A 6/1994 Anderson et al.
5,352,145 A * 10/1994 Raiffe et al. ..... 446/227
5,370,570 A * 12/1994 Harris ..... 446/227
5,555,658 A 9/1996 Yu
5,672,088 A 9/1997 Chininis
5,803,786 A 9/1998 McCormick
5,931,716 A 8/1999 Hopkins et al.
5,951,360 A * 9/1999 Fearon et al. ..... 446/227
5,988,828 A 11/1999 Prince et al.
6,079,855 A * 6/2000 Azeredo et al. ..... 362/356
6,113,455 A * 9/2000 Whelan et al. ..... 446/227
6,150,774 A 11/2000 Mueller et al.
6,236,622 B1 * 5/2001 Blackman ..... 368/10
6,447,362 B2 * 9/2002 Khamphilavong et al. .. 446/227
2001/0055931 A1 12/2001 Khamphilavong et al.

FOREIGN PATENT DOCUMENTS

DE 37 18 369 A1 12/1988
GB 2 019 229 A 10/1979
GB 2245093 A * 12/1991

* cited by examiner

CONVERTIBLE ENTERTAINMENT DEVICE

BACKGROUND

1. Field of the Invention

The present invention relates generally to entertainment devices and more particularly to entertainment devices convertible between multiple configurations.

2. Discussion of the Related Art

Entertainment devices for infants such as mobiles and light projectors are known. Mobiles are typically attached to an infant's crib and are often removed when the infant reaches a certain age. Once removed, the mobile has little or no utility. Light projectors are often placed adjacent an infant's crib to project images on the ceiling to entertain the infant positioned in the crib. While these devices can be used for a greater period of time because of their location outside the crib, their entertainment value diminishes as the child gets older.

What is needed is an improved entertainment device that can be used to entertain an infant and can be converted to perform a useful function when no longer being used to entertain the infant.

SUMMARY OF THE INVENTION

The present invention provides an apparatus having a support arm, and a base coupled to the support arm to maintain the support arm in an upright orientation. The base is moveable between a first orientation in which the base is coupleable to a vertical surface, and a second orientation in which the base can rest on a horizontal surface. A light source is coupled to the support arm. A mobile may also be coupled to the support arm, whereby when the base is in the first orientation, the apparatus can be coupled to a crib rail to function as a crib mobile, and when the base is in the second orientation, the apparatus can rest on a horizontal surface to function as a lamp.

These and other aspects of the present invention will become apparent from the following drawings and description.

BRIEF DESCRIPTION OF THE DRAWINGS

The present invention is described with reference to the accompanying drawings. In the drawings, like reference numbers indicate identical or functionally similar elements.

DETAILED DESCRIPTION

Several embodiments of a convertible entertainment device 10 incorporating the principles of the invention are shown in FIGS. 1–14. A general and functional description of the device are presented first, followed by a description of one implementation.

Figure 1:
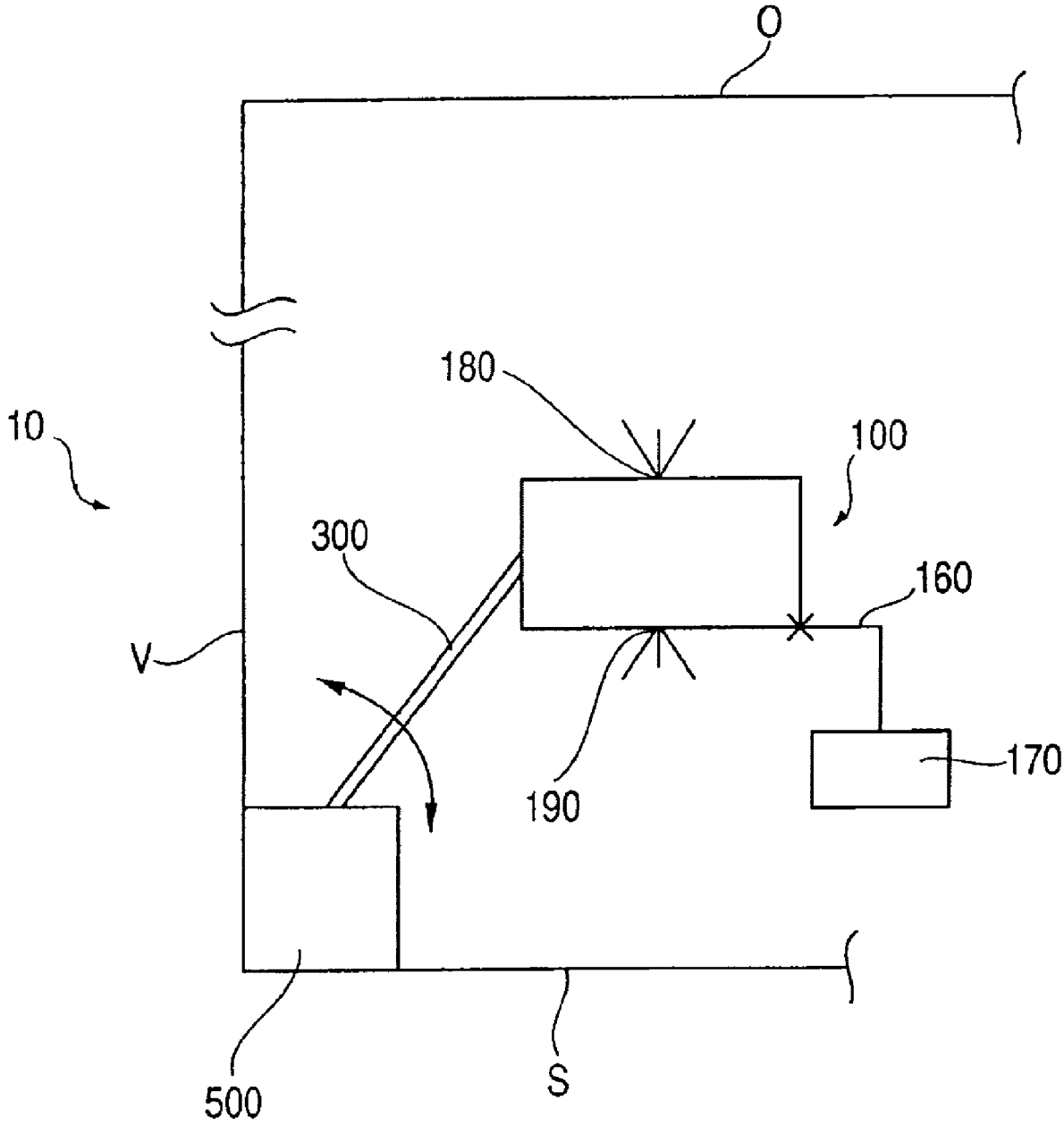
FIG. 1 is a schematic illustration of a generic embodiment of an entertainment device incorporating the principles of the invention.

FIG. 1 is a schematic illustration of a generic embodiment of an entertainment device 10, which includes an entertainment unit 100 that is coupled to a support arm 300 that in turn is coupled to a base 500. The base 500 is coupled to the support arm to maintain the support arm 300 in an upright orientation and is movable between a first orientation in which the base 500 is coupleable to a vertical surface V and, a second orientation in which the base 500 can rest on a horizontal surface S.

The entertainment unit 100 includes a light source 180 that projects on a surface opposite the light source. The opposite surface may be a wall or a ceiling depending upon the configuration of the entertainment device 10 (as will be described in detail below). A second light source 190 also projects on a surface spaced from the entertainment unit 100 (preferably a surface other than the surface illuminated by the first light sources 180. The light source 180, 190 may be illuminated by a single light bulb that illuminates each light source or multiple light bulbs.

An article 170 may be suspended from the entertainment unit 100 via a detachable support 160. The detachable support may be removed from the entertainment unit (as indicated by the "X" in FIG. 1).

When the base 500 is in its first orientation, the entertainment device 10 can be coupled to a vertical surface, such as a crib rail or a wall adjacent the crib, to function as a crib mobile. When the base 500 is in its second orientation, the entertainment device 10 can rest on a horizontal surface S to function as a lamp. Regardless of orientation, the entertainment unit 100 is configured to extend above a surface S, whether it be a crib mattress or a desk surface as described above.

It is also possible to change the orientation of the entertainment device by repositioning the entertainment unit with respect to the support arm 300 and/or repositioning the support arm 300 with respect to the base.

While not illustrated in FIG. 1, entertainment device 10 may include a remote actuator for actuation of the entertainment unit 100.

Figure 2:
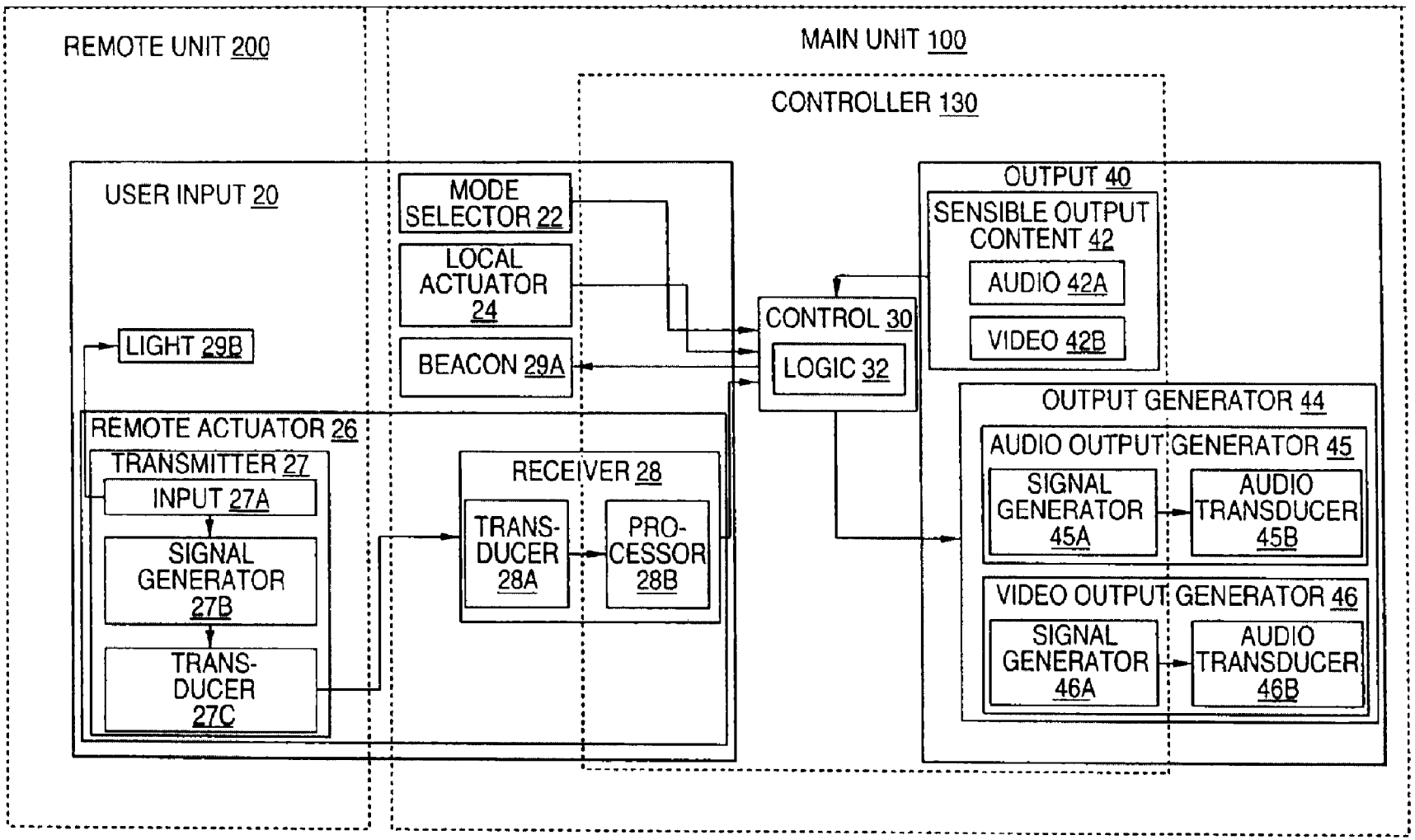
FIG. 2 is a functional block diagram of an embodiment of an entertainment device according to the invention.

FIG. 2 is a schematic illustration of the relationship of various components of entertainment device 10. As shown in the functional block diagram of FIG. 2, convertible entertainment device 10 includes a user input block 20, a control block 30, and an output block 40. In response to user input via the input block 20, the control block controls the output of selected output, such as musical notes, sound effects, light patterns or combinations of musical notes and light patterns, from the output block 40. Regardless of the orientation of the device 10 (i.e., mounted to a vertical surface or freestanding) the functionality described with respect to FIG. 2 is the same.

Output block 40 includes output content 42, which includes audio content 42A, and video content 42B. Audio content 42A can include, for example, in either digital or analog form, musical tones (which can be combined to form musical compositions), speech (recorded or synthesized), or sounds (including recorded natural sounds, or electronically synthesized sounds). Video content can include, for example, in analog or digital form, still or video images, or simply control signals for activation of lamps or other light-emitting devices.

The output content can be communicated to an infant for hearing, or viewing, by output generator 44, which can include an audio output generator 45, and a video output generator 46. Audio output generator 45 can include an audio signal generator 45A, which converts audio output content 42A into signals suitable for driving an audio transducer 45B, such as a speaker, for converting the signals into audible sound waves. Video output generator can include a video signal generator 46A, which converts video output content 42B into signals suitable for driving a video transducer 46B, such as a display screen or lights, for converting the signals into visible light waves. Video output generator can also include moving physical objects, such as miniature figures, to produce visual stimulus to the infant. The selection of the output content, and the performance attributes of the output generators, should be driven by the goal of generating output that is appealing or soothing to an infant. Audio pressure levels should be selected to calm, rather than startle, the infant. Audio content should be pleasing, comforting, and/or rhythmic or melodic.

Control block 30 controls output block 40, selecting the output content to be output and activating the output generator 44 to operate on the selected output content. The operation of control block 30 can be governed by control logic 32, which can be, for example, computer software code. Control logic 32 can select content to be output repetitively or non-repetitively, and/or randomly or in fixed sequences. The video and audio output can be coordinated to enhance the pleasing effect.

User input block 20 includes a mode selector 22, a local actuator 24, and a remote actuator 26, by which the user can provide input to control block 30 to influence the selection of output content and to initiate its output. Mode selector 22 allows the user to select from among output modes. Illustrative output modes include variations of combined video and audio output. For example, the audio content 42A can include a set of musical tones and a set of sound effect segments, and the video content can include a selected sequence of illumination instructions for lamps. Control logic 32 includes sets of sequences in which the musical tones can be output to produce recognizable tunes. Various modes of light operation (i.e., direction of light transmission) may be selected. A program can include a predetermined sequential output of the sets of tone sequences, producing a sequence of musical tunes. Lamps can be illuminated in response to a set of illumination instructions correlated with the playing of the tunes.

The local and remote actuators 24 and 26 allow the user to input simple commands such as "start," "stop," or "repeat" via simple mechanisms such as mechanical contact switches. Local actuator 24 is physically proximate to the output block 40. In contrast, remote actuator 26 includes a transmitter portion 27 that can be operated from a position physically remote from the output block 40, and a receiver portion 28 physically proximate to the output block 40. A command signal can be communicated between the transmitter portion and the receiver portion without a physical link, such as an electromagnetic signal (including infrared and radio frequency) or an acoustical (including ultrasonic), or with a physical link, such as an electrical signal carried by a conductor coupling the transmitter portion and the receiver portion.

In the illustrated embodiment, a wireless short-wave infrared system is used for communication of command signals. The transmitter 26 therefore includes an input button 27A (which the user can press to initiate a command signal), a command signal generator 27B activated by the button 27A, and an infrared emitting transducer (an LED) 27C. Receiver 28 includes an infrared receiving transducer (a photosensor) 28A and a processor 28B to interpret signals received by transducer 28A.

User input block 20 further includes two feedback mechanisms for the user. The first is a beacon light 29A associated with, and physically proximate to, receiving transducer 28A. Beacon light 29A is illuminated (for example, in a flashing or intermittent fashion) when the system is active and ready to receive command signals from the remote actuator 26. This gives the user a visual cue to the system's active state, and further helps the user to locate the system in a darkened room. The second feedback mechanism is a remote signal light 29B associated with, and physically proximate to, transmitting transducer 27C. Signal light 29B is illuminated when the command signal generator 27B is generating command signals, to provide visual confirmation to the user that actuation of the input button 27A has resulted in the production of a command signal.

To use the entertainment device, a user places the output generator and the infant to be soothed within an operative range of one another. The user selects an output mode with mode select 22, and issues a "start" command via local actuator 24 or remote actuator 26. The control 30 receives the mode selection and the start command, selects the corresponding output content, and activates the output generator 44 to generate the selected output content. Use of the remote actuator to issue commands allows the user to be positioned remote from the infant, so that the soothing output can be generated while minimizing the risk that the user will disturb, or attract the attention of, the infant.

Figure 11:
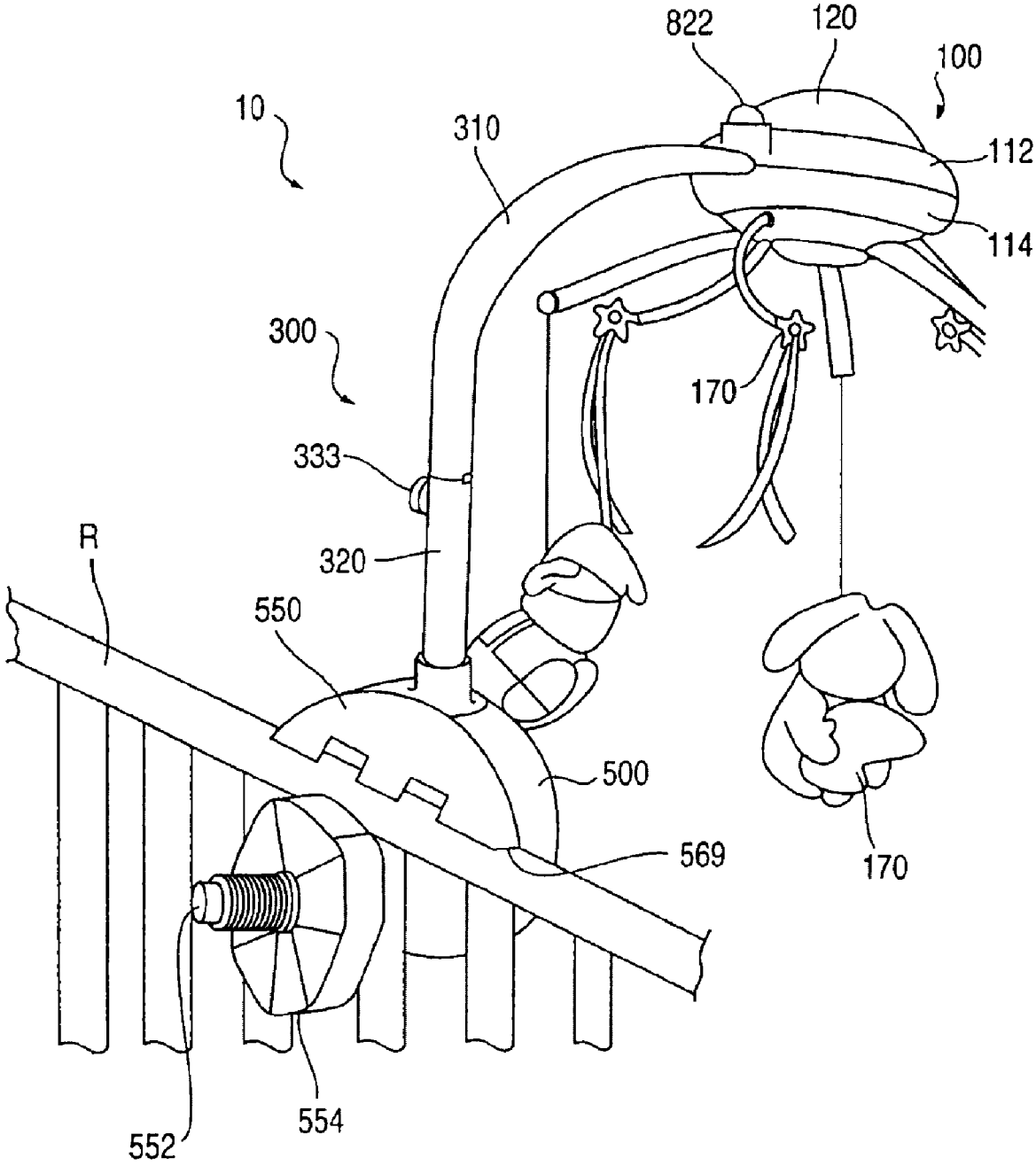
FIG. 11 is a partial rear view of the device illustrated in FIG. 3 shown mounted to a crib rail.
Figure 12:
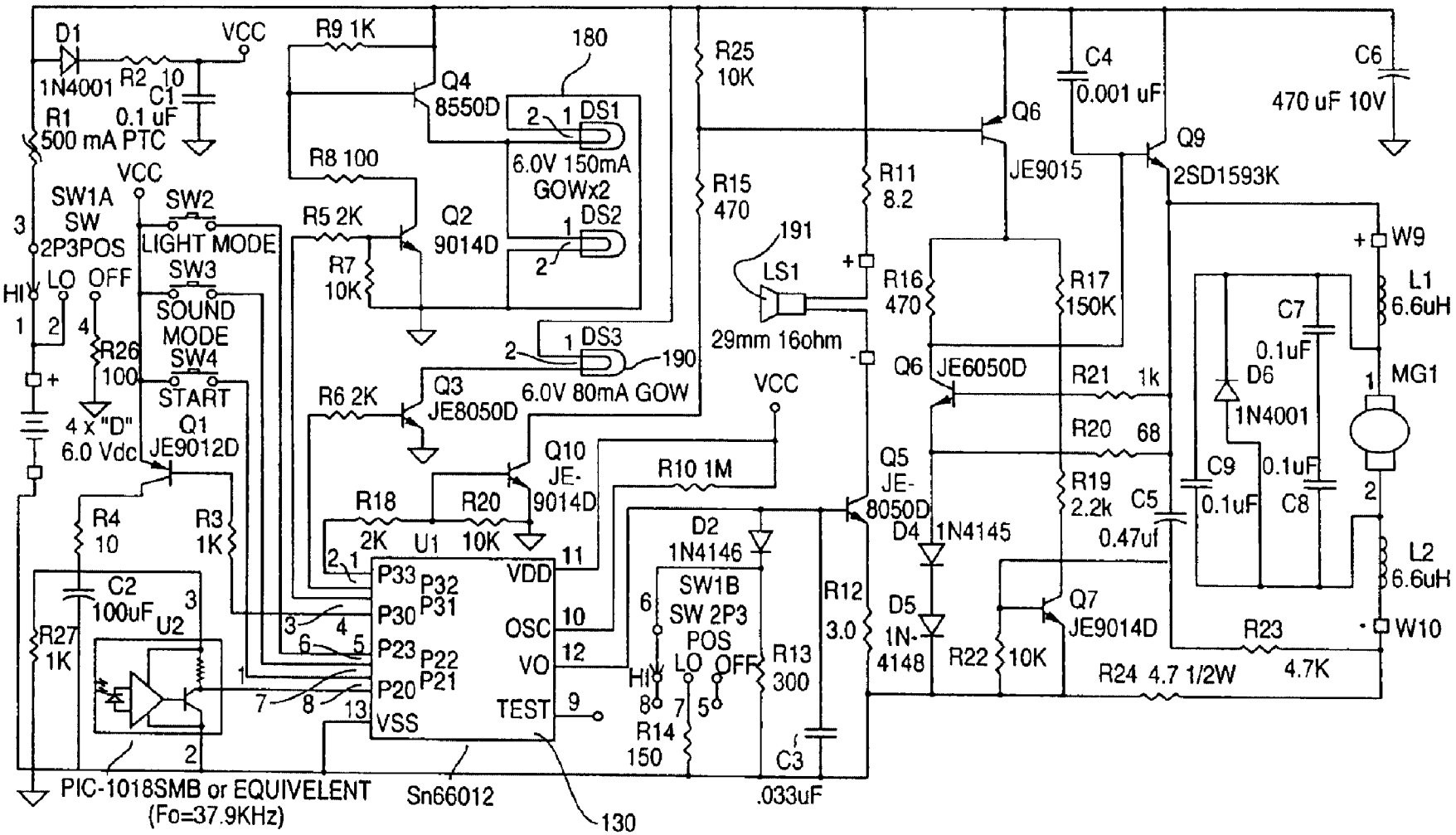
FIG. 12 is an electrical schematic diagram of the device illustrated in FIG. 3.
Figure 13:
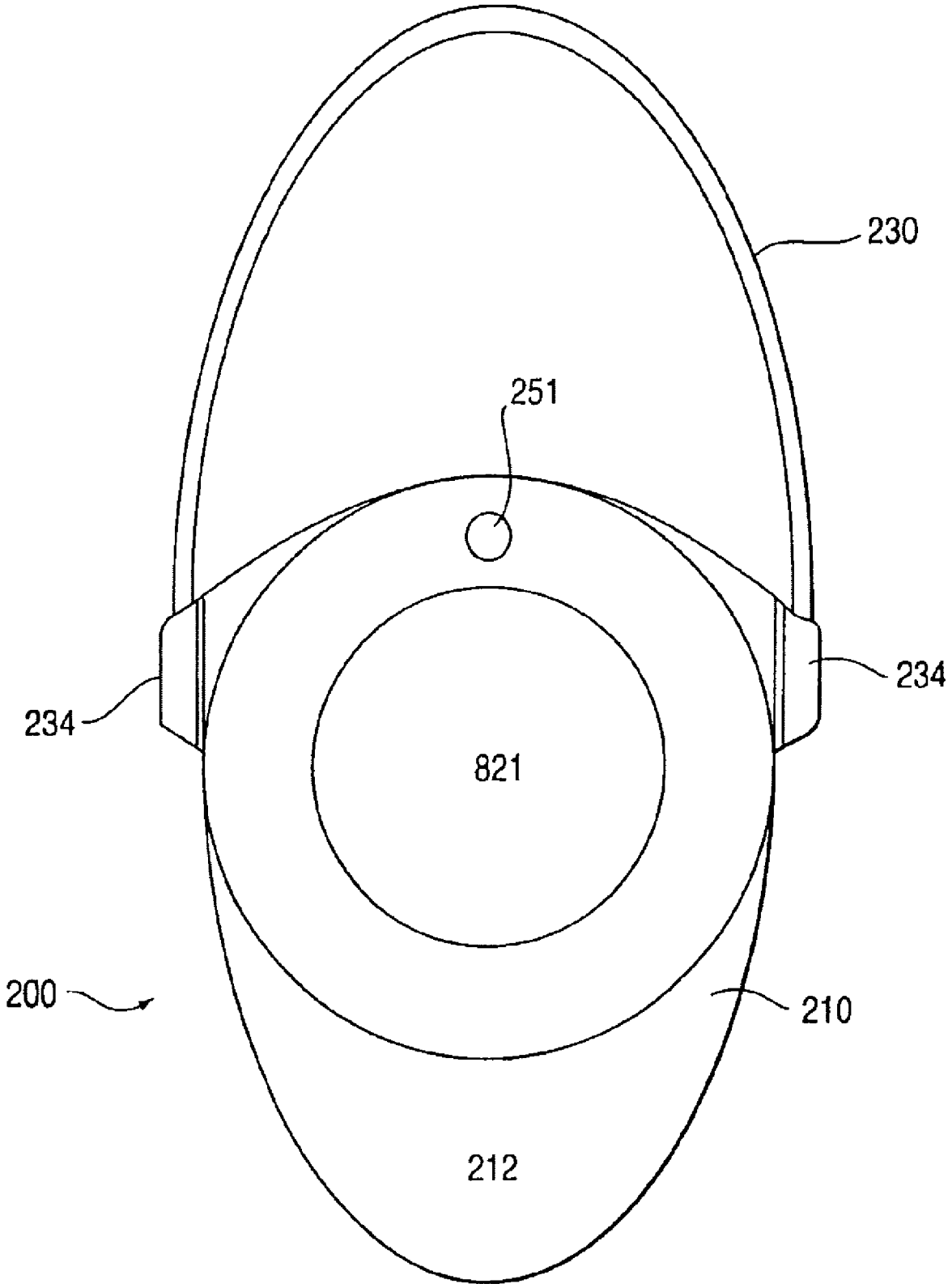
FIG. 13 is a plan view of a remote control unit of the device of FIG. 3.
Figure 14:
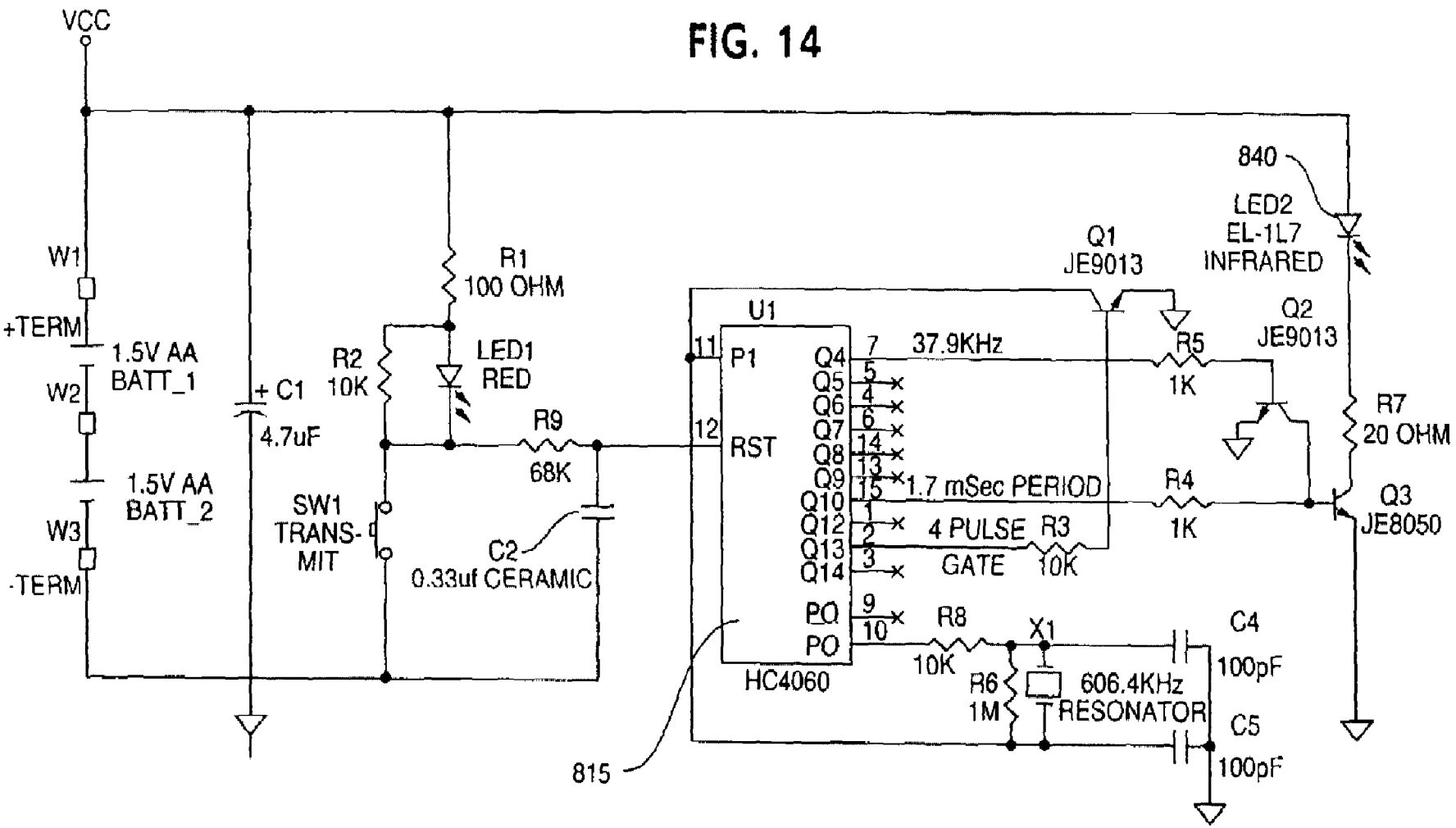
FIG. 14 is a schematic illustration of the remote unit illustrated in FIG. 13.

One implementation of the entertainment device discussed above is now described with reference to FIGS. 3–14. Entertainment device 10 includes an entertainment unit 100 and a remote unit 200. The correspondence between the functional elements and the entertainment unit and remote units is illustrated in FIG. 2 by phantom-lined boxes, identified as entertainment unit 100 and remote unit 200, drawn around the functional elements. Electrical schematic illustrations of the entertainment unit 100 and remote unit 200 are shown in FIGS. 12 and 14, respectively.

Figure 3:
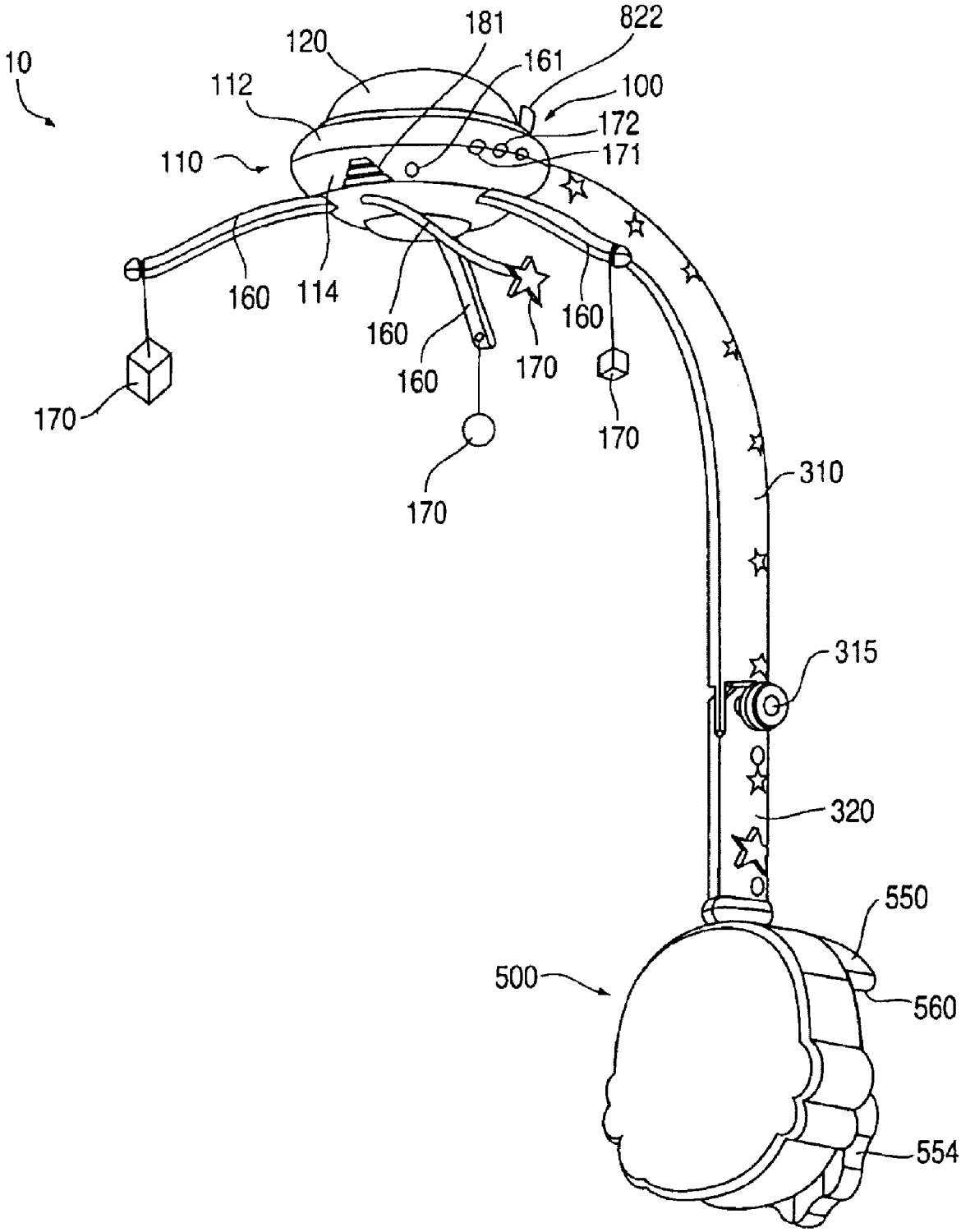
FIG. 3 is a perspective view of another embodiment of an entertainment device embodying the principles of the invention, shown in a first configuration.

Referring first to FIG. 3, entertainment device 10 includes entertainment unit 100 coupled to a support arm 300, which is coupled to a base 500. As described above, the base 500 is movable between a first orientation in which the base is coupleable to a vertical surface, and a second orientation in which the base can rest on a horizontal surface. FIG. 3 illustrates the entertainment device 10 in its first orientation such that the entertainment device 10 can be attached to the rail of a crib or a wall and function as a mobile or similar device. The components that comprise the mobile include detachable supports 160 and suspended articles 170 removably coupled to the ends of detachable supports 160. Suspended articles 170 may take many shapes such as cubes, spheres, animals, stars, etc.

Figure 4:
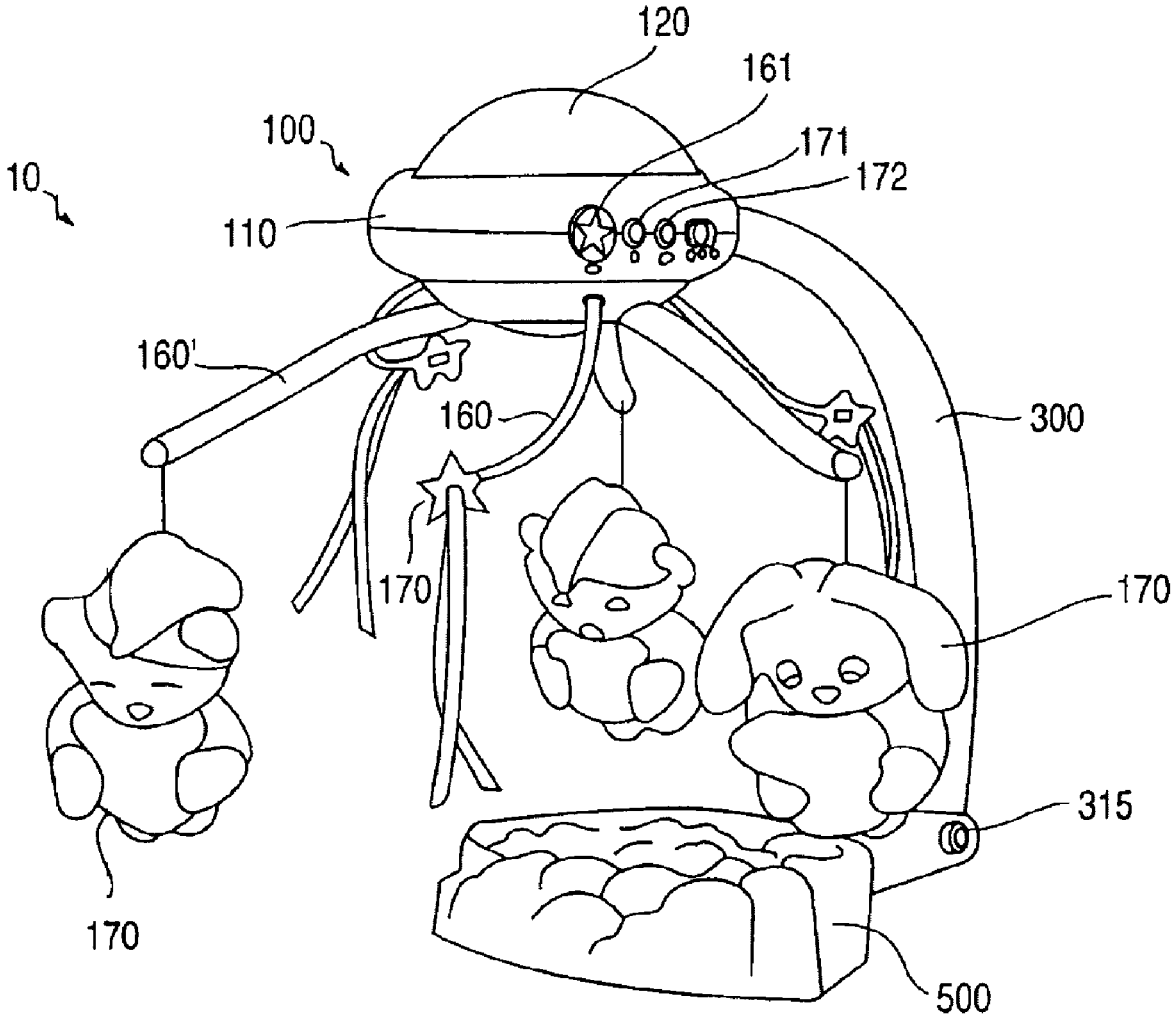
FIG. 4 is a perspective view of the entertainment device of FIG. 3 shown in a second configuration.

The entertainment device 10 can be reconfigured and placed in its second orientation by pivoting the base about pivot 315 such that the base 500 rests on a surface as illustrated in FIG. 4.

Figure 5:
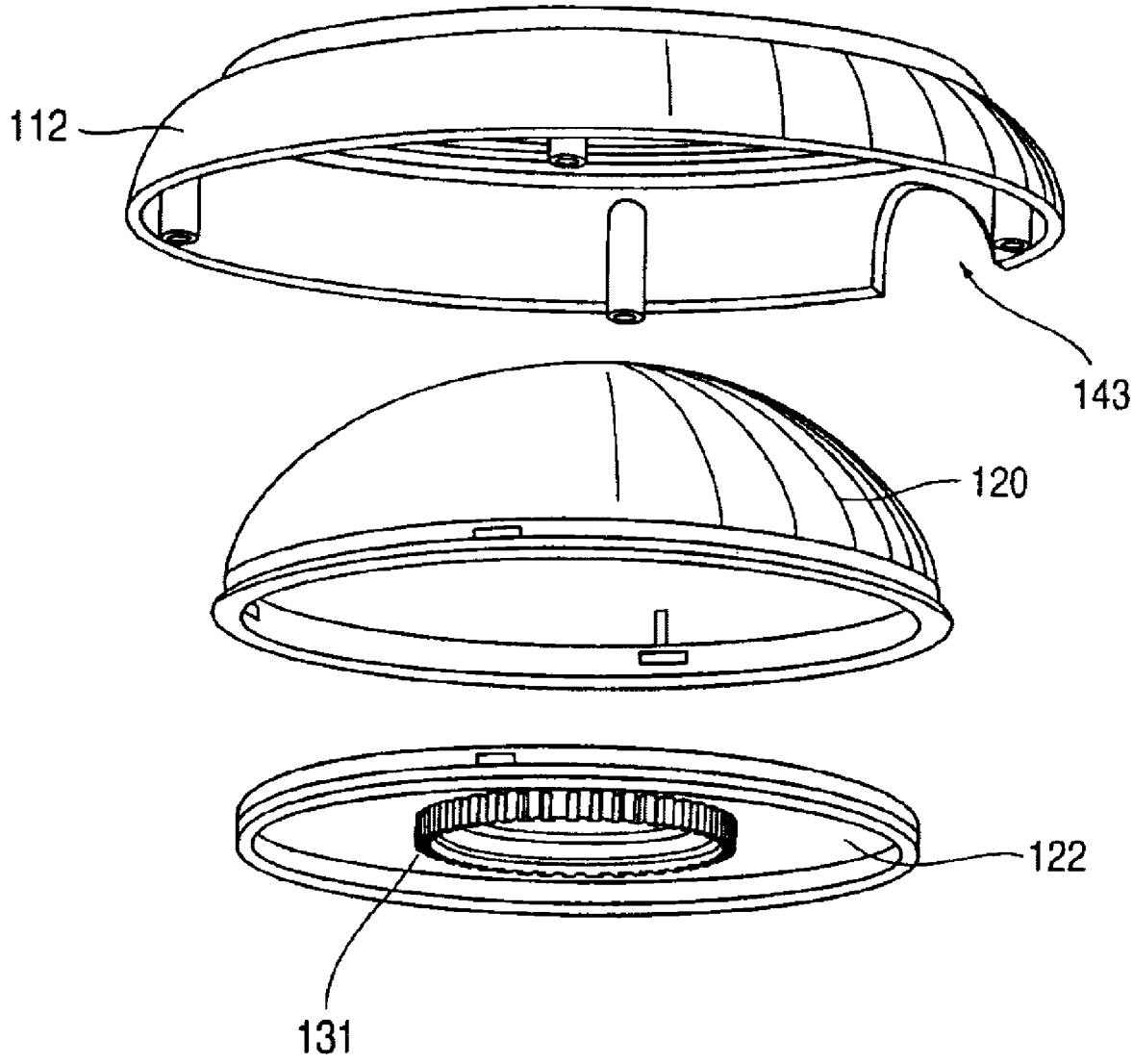
FIG. 5 is a perspective, exploded assembly view of a first portion of the entertainment unit of the device illustrated in FIG. 3.
Figure 6:
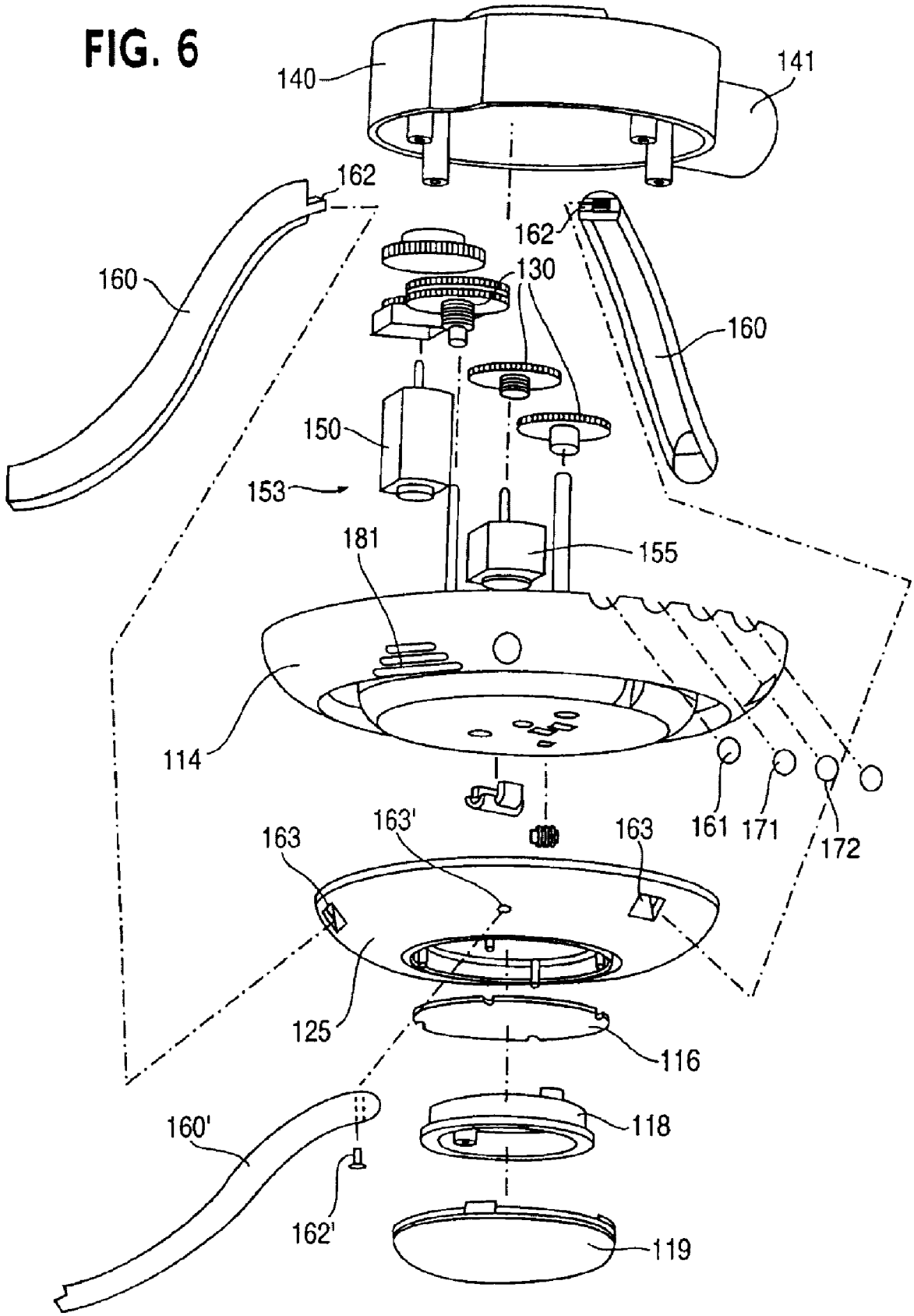
FIG. 6 is a perspective exploded assembly view of a second portion of the entertainment unit of the device illustrated in FIG. 3.

As shown in FIGS. 5 and 6, the elements of entertainment unit 100 are contained and supported in entertainment unit housing 110. Entertainment unit housing 110 is composed of top and bottom housing halves 112, 114.

FIG. 5 illustrates a top portion of entertainment unit 100 and includes top housing half 112 having an opening defined in its sidewall for receiving a conduit of a motor housing 143 as will be described below with respect to FIG. 6. A dome 120 is inserted through the top housing and is coupled to a dome base 122. The dome or cover 120 is disposed above a light source (not visible in FIG. 5) and may include a pattern printed thereon such that when the light source is illuminated, an image corresponding to the pattern is projected on a surface that is spaced from the entertainment unit 100. To provide the appearance of moving images on the surface opposite the entertainment unit 100, a drive assembly is included that rotates the dome base 122. Accordingly, a gear 131 is provided on dome base 122 that meshes with a gear train.

FIG. 6 illustrates an exploded assembly view of the second portion of the entertainment unit 100. Lower housing half 114 is configured to be coupled to top housing half 112 to form the entertainment unit housing 110. Within housing 110 is a motor housing 140 that includes a conduit 141 for receiving wires and the like from the power source, as will be described below. A drive assembly 153 is housed within the motor housing 140 and includes a plurality of drive train 130 (with multiple gears), a first motor 150 and a second motor 155. The first motor 150 is configured to drive train 130 to rotate the dome base 122 as discussed above. The second motor 155 is configured to drive a rotating member 125 that is coupleable to lower housing 114 and is configured to drive the mobile when the entertainment device 10 is in the first configuration.

Audio output generator 44 includes a speaker 191 (not visible in FIG. 6), mounted in entertainment unit housing 110 behind a perforated speaker grill 181. The speaker is a 1" (2.5 cm) diameter driver, and is preferably driven to a sound pressure level of less than approximately 70 dB at 9.8" (24.5 cm) from the axial front of the speaker source.

Detachable supports 160 are releasably coupled to rotating member 125. When the entertainment device 10 is in its first orientation, the detachable supports 160 are coupled to, and operate with, rotating member 125 to function as a mobile. When the entertainment device 10 is placed in its second orientation, the detachable supports 160 may be removed from rotating member 125 so as not to interfere with the light that is projecting downwardly on the surface opposite the entertainment unit 100.

Figure 7:
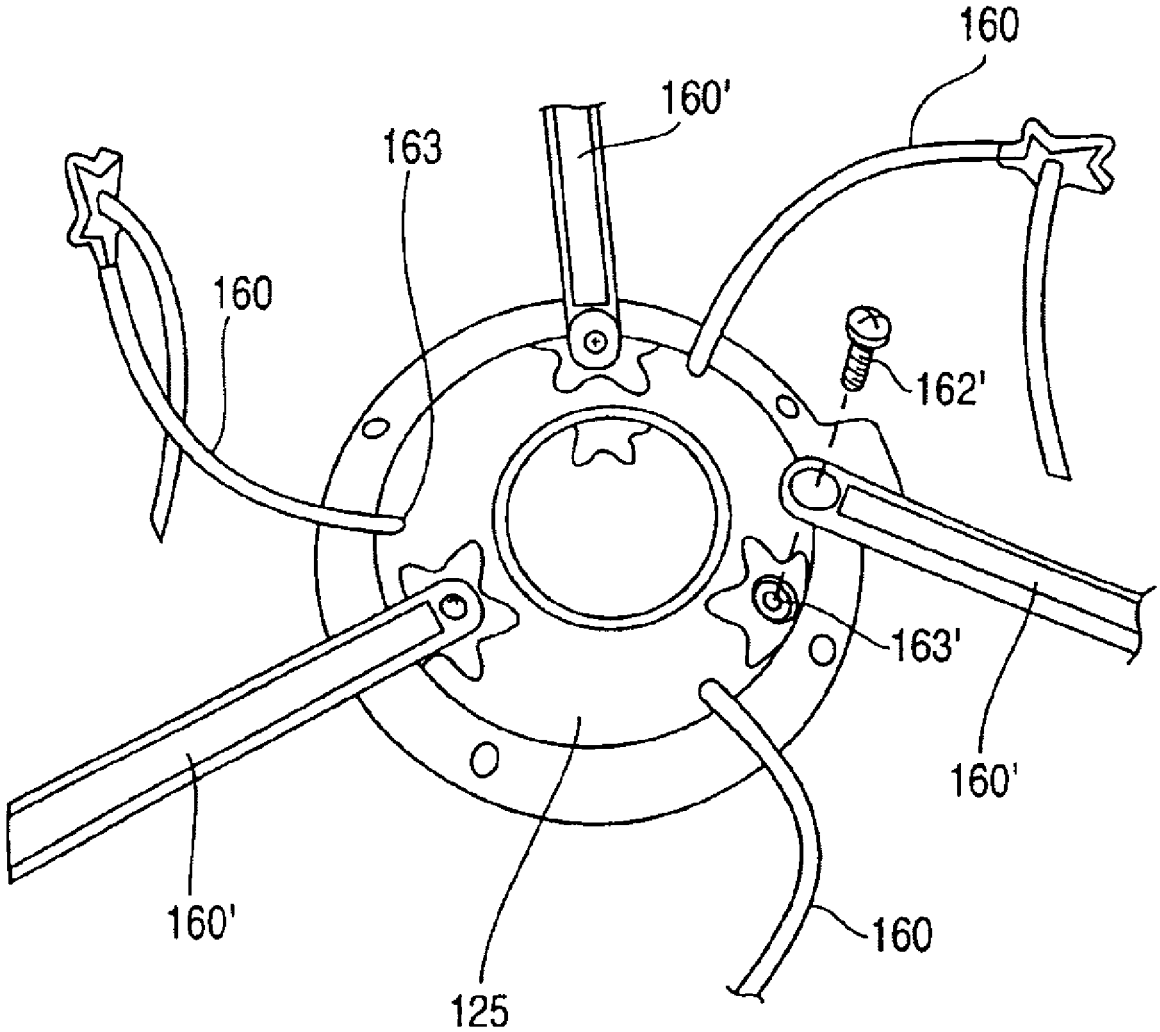
FIG. 7 is a bottom view of the rotating member of the device illustrated in FIG. 3.

The releasable coupling of detachable supports 160 and rotating member 125 can be achieved with a variety of techniques. In the embodiment illustrated in FIG. 6, rotating member 125 includes slots 163 for receiving the detachable supports 160. Detachable supports 160 include a tab 162 that mate with slot 163. FIG. 7 illustrates an alternative coupling technique, in which detachable supports 160' are attached to openings 163' in the rotating member 125 via a fastener 162', such as a screw.

It will be appreciated that the detachable supports 160, 160' may take multiple configurations. For example, the detachable supports 160, 160' may support an article 170 by a string as in a conventional mobile or the article 170 may be fixedly coupled to the end of the support post 160, 160'.

A film 116 may be included between a light source (not visible in FIG. 6) coupled in a receptacle beneath lower housing 114 and the surface opposite entertainment unit 100 to produce an image on the opposing surface. Alternatively, the film 116 may not have any patterns printed thereon and may simply act as a cover for the light. A mounting frame 118 is coupled to rotating member 125 to maintain the position of the film 116. Finally, a lower dome 119 is coupled to the rotating member 125. The lower dome may be transparent or opaque and may or may not have patterns printed thereon. In an alternative embodiment the film 116 may not be utilized and any image that is desired to be produced may be printed on the dome alone.

Figure 8:
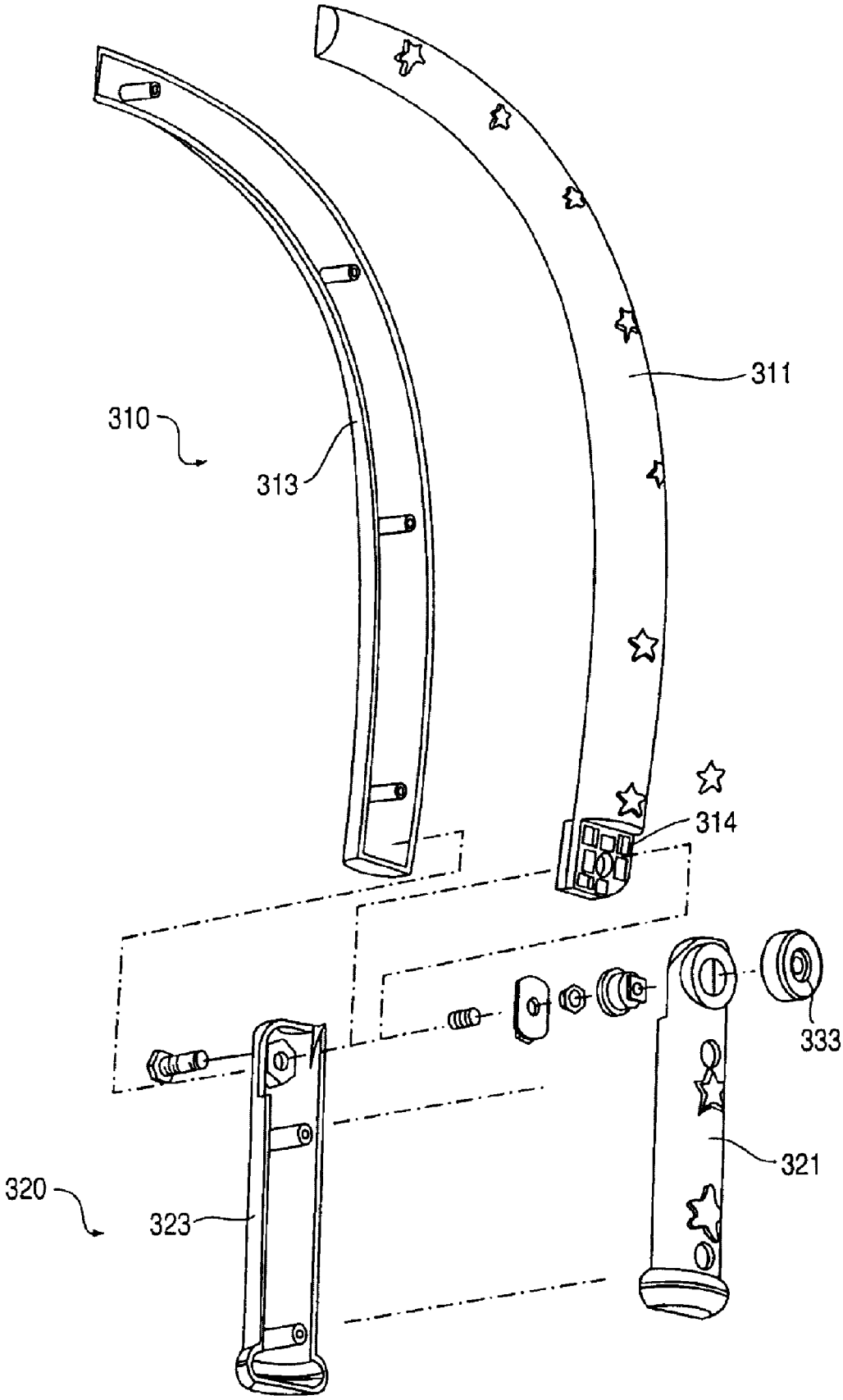
FIG. 8 is a perspective exploded assembly view of the support arm of the device illustrated in FIG. 3.

Referring to FIG. 8, support arm 300, by which the housing can be mounted to a supporting structure such as an infant crib, is illustrated in greater detail. Support arm 300 is coupled to the entertainment unit housing 110 and includes a first portion 310 and a second portion 320. The first portion 310 includes a first side 311 and a second side 313 that couple together to form the first portion 310. The first portion 310 is provided with an opening 314 that is in registry with an opening in the second portion 320 such that together the first portion 310 and second portion 320 form support arm 300. The second portion 320 includes a first side 321 and a second side 323 that couple together around the opening 314. The connection between first portion 310 and second portion 320 may be a simple pivot connection such that when a knob 333 is loosened, the second portion 320 is able to pivot around pivot point 315 (see FIG. 3). Alternatively, the connection between first portion 310 and second portion 320 may be a spring-loaded clutch such that no knob need be provided and simple application of force is enough to change the orientation of support arm 300. In a further alternative embodiment, the lower portion 320 of support arm 300 may be provided with multiple sockets (not shown) for receiving first portion 310. For example one socket may be situated on a longitudinal axis of the lower portion, and a second socket may be perpendicular to the first socket such that the first portion may be friction fit in either of the alternative sockets to change the orientation of the support arm 300.

Figure 9:
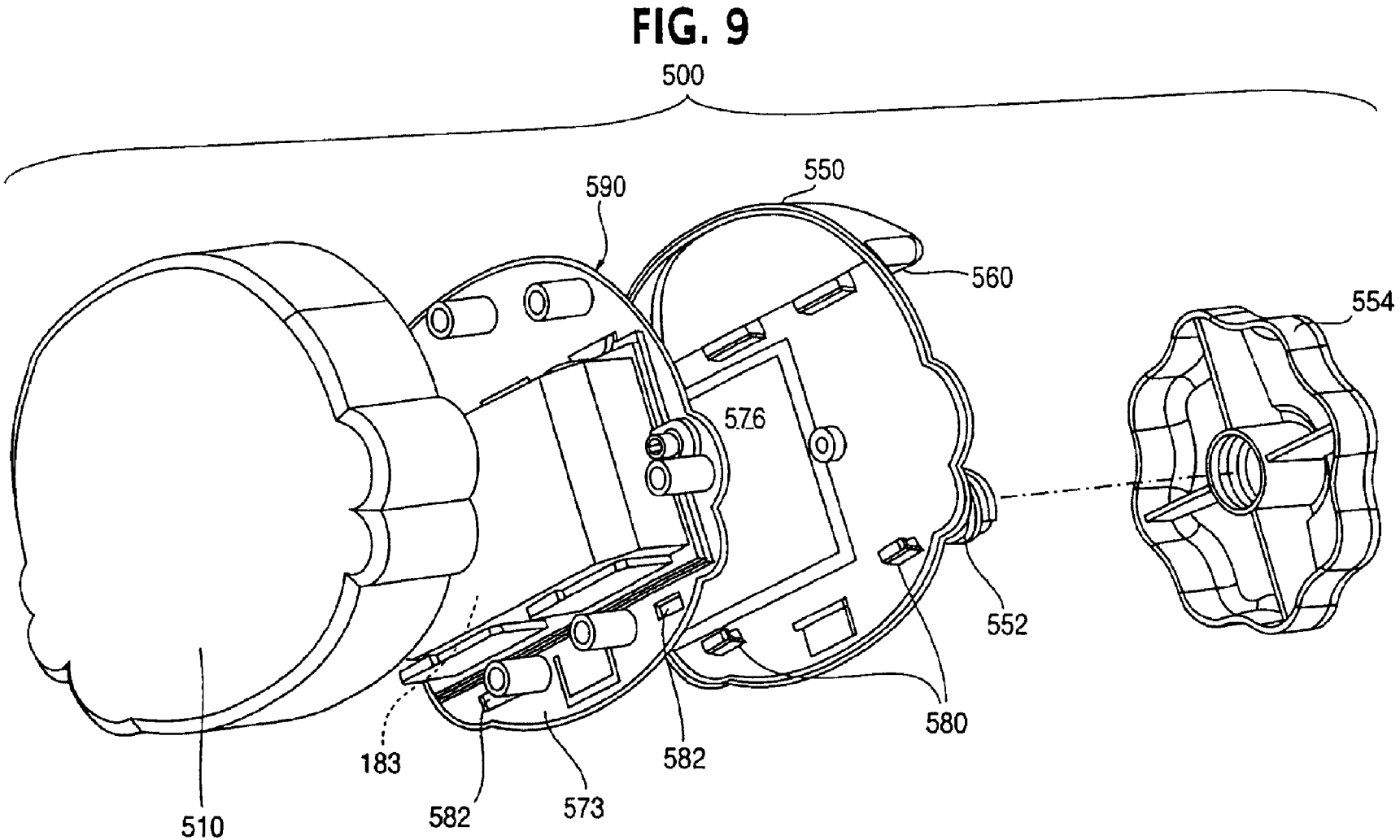
FIG. 9 is perspective exploded assembly view of the base of the device illustrated in FIG. 3.

Referring to FIG. 9, the base 500 includes a base cover 510 that receives housing 573. Housing 573 includes a face 590 that defines openings or clip retainers 582. A mounting apparatus 550 for mounting the entertainment unit 100 on a fixed support, such as an upper rail R of an infant's crib is removably coupled to housing 573, such as, for example, by attachment clips 580 that mate with clip retainers 582. The mounting apparatus 550 includes a threaded mounting post 552 that is externally threaded and is configured to couple with mounting nut 554 that is internally threaded. Battery cover 576 covers a battery housing 575 and is flush with face 590 of housing 573.

Figure 10:
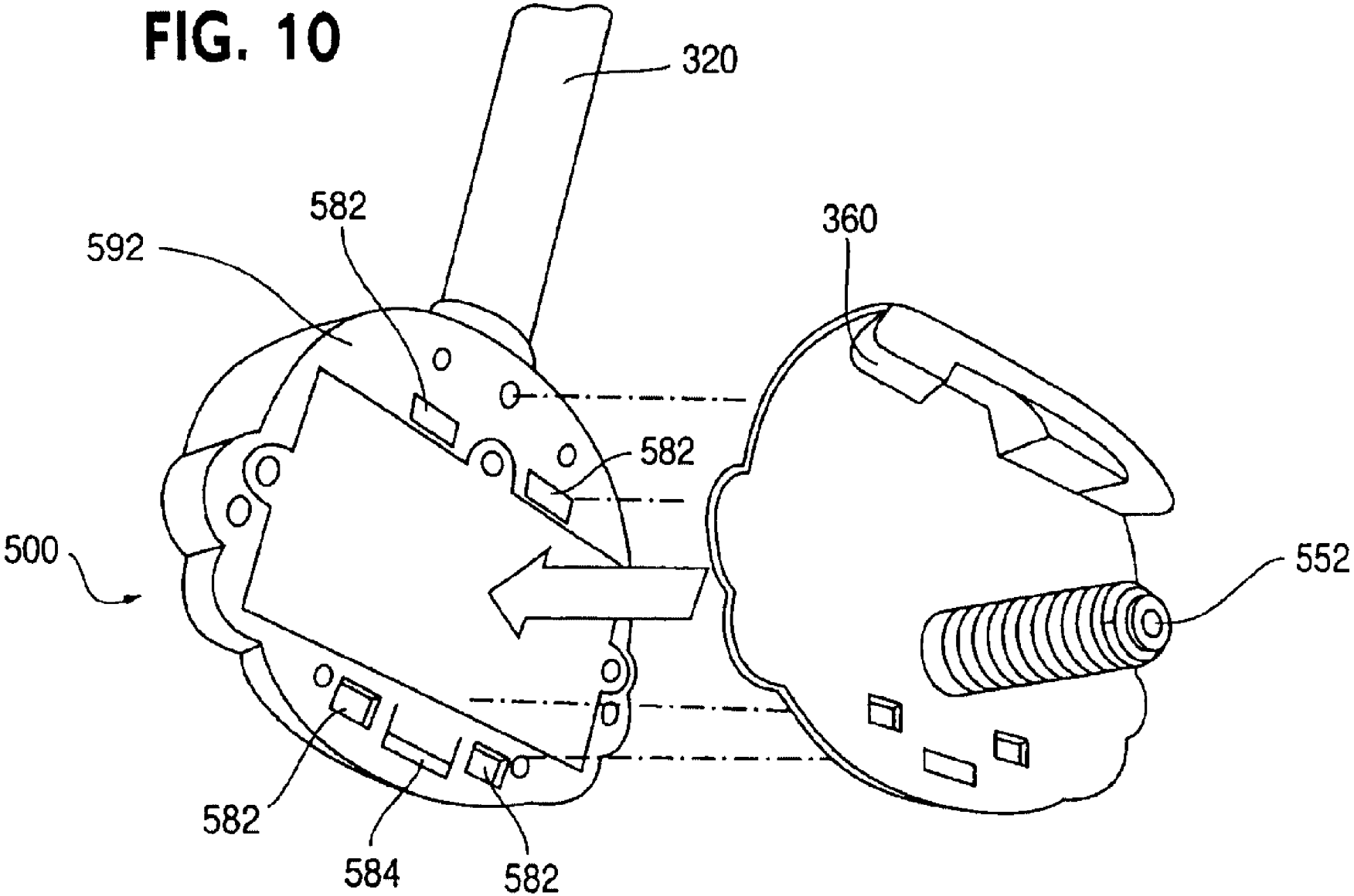
FIG. 10 is a perspective exploded assembly view of a crib mount of the device illustrated in FIG. 3.

As best seen in FIG. 10 the mounting apparatus 550 is able to couple to the face 590 via openings 582 in housing 573. Openings 582 could be configured as keyhole slots to mount on screws or nails protruding from a wall. There is also a release clip 584 that engages an opening in the mounting apparatus 550. As shown in FIG. 11, entertainment unit 100 can be mounted to rail R of a crib with the mounting apparatus 550 abutting the rail R at surface 560 when the mounting apparatus 550 is in place.

Mounting apparatus 550 is configured to be easily removed from housing 573. When the entertainment device 10 is in its first configuration (FIG. 3), the mounting apparatus 550 is attached to face 590. When the mounting apparatus 550 is removed, the entertainment device can be reoriented such that face 590 abuts a supporting surface upon which the entertainment device 10 is to be situated.

The audio signal generator 46*a*, video signal generator 45A, output content 42, and control block 30 are all implemented in the illustrated embodiment on controller 130, which is a model SN66012 available from Sonix Corporation. The audio content 42A is stored in digital form in a memory portion of controller 130. Audio content 42A includes sets of tone identifiers arranged in sequences corresponding to musical tunes. Seven such sets of tone identifiers are stored, allowing generation of ten musical tunes, such as Brahm's Lullaby, Twinkle Twinkle Little Star, Moonlight Sonata, Ocean Sounds, Night Time Sounds, etc. Controller 130 has the built-in capability to produce tones identified by the tone identifiers, and to drive speaker 191 to the desired sound pressure level.

The physical implementation of user input block 20 will now be described. Local actuator 24 is implemented as entertainment unit input switch SW4 (illustrated in FIG. 12), which is a momentary contact switch with button 161 mounted to the top 112 of entertainment unit housing 110 (see FIG. 3), where it is readily accessible and easily activated.

Mode selector 22 is implemented as mode select switches SW2 and SW3 (illustrated in FIG. 12), which are momentary contact switches, with buttons 171, 172 positioned on the housing (see FIG. 6), where they are readily accessible. The output lines from mode select switches SW2 and SW3 are coupled to controller 130 to provide signals to select the modes of operation for the entertainment device 10. As described in more detail below, there are multiple modes of operation.

Remote actuator 26 is implemented as a short-wave infrared remote control system with components in the entertainment unit 100 and in the remote unit 200. The receiver 28 is implemented as remote receiver, with a photo sensor 822 (corresponding to receiving transducer 28A), which converts incident light in the short-wave infrared spectrum into electrical signals supplied to controller 130, which includes the function of command signal processor 28B to process the electrical signals received from photosensor 822 and determine whether the received IR signal is a command signal from remote transmitter 27.

As shown in FIG. 3, photosensor 822 is disposed on upper portion 112 of entertainment unit housing 110. The photosensor 822 has an effective angular field of view within which it can effectively detect incident IR signals. The field of view is approximately 90 degrees.

Power for the electronic components of entertainment unit 100 is supplied by entertainment unit power supply 183, which in the illustrated embodiment consists of batteries (four C-sized cells), which are housed in battery compartment 575 and accessed via battery cover 576. Wires are channeled through support arm 3400 and conduit 141 to drive the electronic components.

Remote transmitter 27 of remote actuator 26 is implemented as an infrared transmitter, which is housed in remote unit 200. The remote unit 200 is similar to the remote unit described in U.S. Pat. No. 6,116,983, which is assigned to the assignee of the present invention and is incorporated herein by reference in its entirety. The infrared transmitter includes a remote controller 315 (corresponding to signal generator 27B) that generates an electronic signal that is communicated to transmission LED 840 (corresponding to transmission transducer 27C), which in turn generates an IR command signal. In the illustrated embodiment, the remote controller 815 is a 14 stage binary counter model 74HC4060, which is a standard part commercially available from a variety of sources.

Operation of controller 815 is initiated by the user by actuating remote input switch SW1 (corresponding to input 27A), which in the illustrated embodiment is a momentary contact switch with a large circular remote button 821.

The components of the infrared transmitter 810 are housed in remote housing 210 of remote unit 200. The remote unit 200 includes a remote unit housing 210, which is formed of a housing top 212, and a housing bottom (not visible in FIG. 13). Remote unit 200 includes a U-shaped handle 230, which is pivotally mounted to housing 210 by handle pivot posts 234 that are trapped within mating semicircular cutouts in housing top 212 and housing bottom. The remote 200 can be carried or hung by the handle. FIG. 13 shows the handle 230 in a deployed position. In the deployed position, there is sufficient space between the handle 230 and the remote housing 210 to accommodate a standard doorknob (not shown). The handle 230 can therefore be used to allow a parent to hang the remote unit on, for example, a doorknob at the entrance of an infant's bedroom so that the remote unit is accessible to the parent who wishes to produce output for the infant without disturbing or gaining the attention of the infant by his or her presence.

An IR-transparent window (not shown) is also trapped between the housing top 212 and housing bottom. Transmission LED 840 is mounted in the housing behind the window. The remote unit uses batteries for a power supply. Remote button 821 is mounted in housing top 212. Indicator light 251 (corresponding to light 29B) is mounted in housing top 212 in front of button 821. A power supply (two AA batteries, in the disclosed embodiment) is also contained in a battery compartment of housing 210, and are accessed by a removable battery cover as would be apparent to those skilled in the art.

The remote unit 200 produces IR control signals for activating the entertainment unit 100 at a remote distance, preferably at a minimum of 20' (6 m) from the remote receiver in normal household lighting conditions.

As stated earlier, the entertainment device 10 is activated by receiving the IR control signal from the remote unit 200 (the entertainment device can also be activated by pressing the manual activation button 161). The control signal transmitted from the remote unit 200 is detected by a remote receiver with a photo sensor for detecting short-wave IR signals modulated on a 37.9 kHz carrier frequency.

The operation of the entertainment device 10 will now be described with reference to FIGS. 3–10. As discussed above, the operation of the lights speaker 195, and beacon light 129 are controlled by controller 130. Controller 130 receives input from the remote receiver 820 or local actuator button 161 and responds by causing the speaker 191 and/or lights to produce output depending on the mode selected by the user via mode selectors 171, 172 or the nature of the IR command received. If remote receiver 820 recognizes signals from photo sensor 822 as the command signal, and an output mode is selected, then the controller 130 will cause output to be produced.

The IR command signals must be received while the entertainment unit 100 is active. Controller 130 includes an internal timer by which it can monitor the time that has elapsed since a command signal was last received. If the elapsed time exceeds an established standby period, the receiver 820 portion of the remote control will shut down to conserve power. Once powered-down, the entertainment unit 100 will not produce output in response to a second control signal but will continue to respond to a user pressing the manual button 161. Pressing the manual button 161 will also power-on the remote receiver 820, making the entertainment unit 100 "remote ready." The entertainment unit will also become "remote ready" if the user selects a new output mode, other than "off," using the mode selector 171, 172. Once the entertainment unit 100 is "remote ready," the user can thereafter activate the entertainment device via an IR command signal. There is no output generated when the mode selector switches 171, 172 are set to "off."

In the illustrated embodiment, the various housing components, buttons, etc. are formed of plastic materials, but any other material suitable for use can be used.

Although the disclosed audio generator has a fixed output volume, it is contemplated that a volume control could be added to permit the user to vary the output.

The power supply is disclosed as batteries, but it is contemplated that alternative sources of power could be used, including household AC power. Moreover, it is contemplated that if AC power were used, the receiver portion of the remote could always be "remote ready" since there would not be the same level of concern with conserving power.

The remotely controlled output, as disclosed, uses a simple, one-function remote, however, other remotes with greater functionality are contemplated. For example, it is contemplated that remotes with buttons for remotely selecting output modes or remotes which transmit Radio-Frequency (RF) verses Infra Red (IR) signals.

CONCLUSION

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

The previous description of the preferred embodiments is provided to enable any person skilled in the art to make or use the present invention. While the invention has been particularly shown and described with reference to preferred embodiments thereof, it will be understood by those skilled in the art that various changes in form and details may be made therein without departing from the spirit and scope of the invention.

What is claimed is:

1. An apparatus, comprising:

a support arm having a longitudinal axis;

a base having a mounting surface, the base pivotally coupled to said support arm, the support arm being reconfigurable between a first orientation in which said mounting surface of said base is substantially parallel to the longitudinal axis and coupleable to a vertical surface, and a second orientation in which said mounting surface of said base is substantially perpendicular to the longitudinal axis and can be freestanding on a horizontal surface;

a light source coupled to said support arm; and a mobile removably coupled to said support arm, whereby when said support arm is in said first orientation, said apparatus can be coupled to a crib rail to function as a crib mobile, and when said support arm is in said second orientation, said apparatus can be freestanding on a horizontal surface to function as a lamp.

2. The apparatus of claim 1, further comprising a projection unit.

3. The apparatus of claim 2, said light source being a first light source and wherein said projection unit includes:

a second light source; and a cover disposed above said second light source and having a pattern thereon, such that when said second light source is illuminated, an image corresponding to said pattern is projected on a surface spaced from said projection unit.

4. The apparatus of claim 1, further comprising an audio output device coupled to said support arm.

5. The apparatus of claim 1, further including a remote actuator for initiation of said mobile and said light source.

6. The apparatus of claim 1, further comprising a drive assembly for causing rotation of said mobile.

7. The apparatus of claim 1, said mobile comprising:

a plurality of suspension arms; and a toy suspended from each of said suspension arms.

8. An apparatus, comprising:

an entertainment unit having a projection unit, a soothing unit and an audio output device, said soothing unit including a mobile disposed substantially beneath said projection unit, said projection unit including at least one light source receptacle;

a base; and a support arm having a first portion and a second portion, the first portion being coupled to the entertainment unit, the second portion having a longitudinal axis, the second portion being pivotally coupled to the base such that the support arm can be positioned in a first configuration in which said base is coupleable to a substantially upright support and a second configuration in which the apparatus is freestanding on a support surface such that the longitudinal axis of the second portion is substantially parallel to the support surface.

9. The apparatus of claim 8, further including a remote actuator for initiating operation of said entertainment unit.

10. The apparatus of claim 8, said projection unit comprising:

a cover disposed above said light source receptacle and having a pattern thereon, such that when a light source disposed in said receptacle is illuminated, an image corresponding to said pattern is projected on a surface.

11. The apparatus of claim 10, wherein said cover is rotatable about said light source receptacle.

12. The apparatus of claim 8, said soothing unit comprising:

a suspension element; and an article suspended from said suspension element.

13. The apparatus of claim 8, said soothing unit comprising:

a light source receptacle; and a cover disposed beneath said light source receptacle.

14. The apparatus of claim 8, said mobile comprising:

a suspension element; and an article suspended from said suspension element.

15. The apparatus of claim 14, wherein said suspension element is removably coupled to said entertainment unit.

16. The apparatus of claim 8, wherein in said first configuration, said longitudinal axis of the second end and said base are substantially linearly arranged and in said second configuration, said longitudinal axis of the second end is substantially perpendicular to said base and said base engages the support surface.

17. The apparatus of claim 8, wherein in said first configuration said base is coupleable to a crib and said entertainment unit is configured to be disposed above an infant in the crib and in said second configuration said entertainment unit is disposed substantially above said base.

18. The apparatus of claim 8, further comprising:

a mounting device coupleable to said base and said substantially upright support.

19. An apparatus, comprising:

an entertainment unit including at least one light source receptacle and an audio output device; and a support arm having a first portion coupled to said entertainment unit and a second portion having a longitudinal axis, said second portion being pivotally coupled to said first portion such that said support arm has a first configuration in which said second portion is selectively engageable with a vertical support surface such that the longitudinal axis of the second portion is substantially parallel to the vertical support surface and a second configuration in which said second portion is selectively engageable with a horizontal support surface such that the apparatus can be freestanding such that the longitudinal axis of the second portion is substantially parallel to the horizontal support surface.

20. The apparatus of claim 19, wherein said entertainment unit includes a projection unit.

21. The apparatus of claim 20, said projection unit comprising:

said light source receptacle; and a cover disposed above said light source receptacle and having a pattern thereon, such that when a light source is illuminated, an image corresponding to said pattern is projected on a distant surface.

22. The apparatus of claim 21, wherein said cover is rotatable about said light source receptacle.

23. The apparatus of claim 19, wherein said entertainment unit includes a soothing unit.

24. The apparatus of claim 23, wherein said soothing unit includes:

a light source receptacle; and a cover disposed beneath said light source receptacle.

25. The apparatus of claim 24, said soothing unit further comprising:

a suspension element; and an article suspended from said suspension element.

26. The apparatus of claim 25, wherein said suspension element is removably coupled to said entertainment unit.

27. The apparatus of claim 23, said soothing unit comprising:

a suspension element; and an article suspended from said suspension element.

28. The apparatus of claim 19, wherein in said first configuration said first portion and said second portion are substantially linearly arranged and in said second configuration said first portion is substantially perpendicular to said second portion and said second portion engages the horizontal support surface.

29. The apparatus of claim 19, wherein in said first configuration said second portion of said support arm is coupleable to a crib and said entertainment unit is configured to be disposed above an infant in the crib and in said second configuration said entertainment unit is disposed substantially above said second portion of said support arm.

30. A crib mobile and lamp, comprising:

a base;

a support arm pivotally coupled at a first end portion thereof to said base for movement between a first orientation and a second orientation in which the base can be freestanding on a support surface such that a longitudinal axis of the first end portion is substantially perpendicular to the support surface;

a mount configured to be removably coupled and recoupleable to said base to selectively couple said base to a side rail of a crib when said support arm is in said first orientation;

a housing coupled to a second end of said support arm;

a light source mounted on said housing and oriented to illuminate the support surface when said support arm is in said second orientation;

a mobile mounted to said housing, said mobile including a plurality of detachable article supports;

a drive mounted in said housing and coupled to said mobile to rotate said mobile with respect to said housing.

31. The crib mobile and lamp of claim 30, said light source being a first light source and further including:

a second light source; and a cover disposed above said second light source and having a pattern thereon, such that when said second light source is illuminated, an image corresponding to said pattern is projected on a surface spaced from said second light source.

32. The crib mobile and lamp of claim 30, further comprising an audio output device coupled to said support arm.

33. The crib mobile and lamp of claim 30, further including a remote actuator for initiation of said mobile and said light source.

34. An apparatus, comprising:

an entertainment unit having a projection unit and a soothing unit, said soothing unit including a mobile disposed substantially beneath said projection unit, said projection unit including at least one light source receptacle, a cover disposed above said light source receptacle and having a pattern thereon, such that when a light source disposed in said light source receptacle is illuminated, an image corresponding to said pattern is projected on a surface;

a support arm having a longitudinal axis; and a base having a mounting surface, said base pivotally coupled to said support arm, such that the support arm has a first orientation in which said mounting surface of said base is substantially parallel to the longitudinal axis and coupleable to a vertical surface, and a second orientation in which said mounting surface of said base is substantially perpendicular to the longitudinal axis and can be freestanding on a horizontal surface.

35. The apparatus of claim 34, wherein said cover is rotatable about said light source receptacle.

36. An apparatus, comprising:

an entertainment unit having a projection unit and a soothing unit, said soothing unit including a mobile disposed substantially beneath said projection unit, said projection unit including at least one light source receptacle, said soothing unit including a light source receptacle; and a cover disposed beneath said light source receptacle of said soothing unit; and a support arm having a first portion coupled to said entertainment unit and a second portion having a longitudinal axis, said second portion being pivotally coupled to said first portion such that said support arm has a first configuration in which said second portion is coupleable to a substantially upright support such that that the longitudinal axis of the second portion is substantially parallel to the substantially upright support and a second configuration in which the second portion is freestanding such that the longitudinal axis of the second portion is substantially parallel to a substantially horizontal support.

37. The apparatus of claim 36, said mobile further comprising:

a suspension element; and an article suspended from said suspension element.

38. The apparatus of claim 37, wherein said suspension element is removably coupled to said mobile.

39. An apparatus, comprising:

an entertainment unit including a projection unit, the projection unit including a light source receptacle, and a cover disposed above said light source receptacle and having a pattern thereon, such that when a light source is disposed in said light source receptacle and illuminated, an image corresponding to said pattern is projected on a distant surface; and a support arm having a first portion coupled to said entertainment unit and a second portion having a longitudinal axis, said second portion being pivotally coupled to said first portion such that said support arm has a first configuration in which said second portion is selectively engageable with a vertical support surface such that the longitudinal axis of the second portion is substantially parallel to the vertical support surface and a second configuration in which said second portion can be freestanding on a horizontal support surface such that the longitudinal axis of the second portion is substantially parallel to the horizontal support surface.

40. The apparatus of claim 39, wherein said cover is rotatable about said light source receptacle.

* * * * *